US011846133B2

(12) United States Patent
Plummer et al.

(10) Patent No.: US 11,846,133 B2
(45) Date of Patent: Dec. 19, 2023

(54) POWER BOOST MODULE

(71) Applicant: Schlage Lock Company LLC, Carmel, IN (US)

(72) Inventors: Brady Plummer, Fishers, IN (US); Subashchandra G. Rai, Bangalore (IN); Brian C. Eickhoff, Danville, IN (US); Benjamin L. Miller, Indianapolis, IN (US); Prajna Poojary, Udupi District (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 17/499,394

(22) Filed: Oct. 12, 2021

(65) Prior Publication Data

US 2022/0170308 A1 Jun. 2, 2022

Related U.S. Application Data

(63) Continuation of application No. 16/713,196, filed on Dec. 13, 2019, now Pat. No. 11,142,939.

(51) Int. Cl.
*E05F 15/63* (2015.01)
*E05F 3/22* (2006.01)

(52) U.S. Cl.
CPC ..... *E05F 15/63* (2015.01); *E05F 3/224* (2013.01); *E05Y 2201/412* (2013.01);
(Continued)

(58) Field of Classification Search
CPC . E05F 15/63; E05F 15/60; E05F 15/70; E05F 15/40; E05F 15/41; E05F 15/603;
(Continued)

(56) References Cited

U.S. PATENT DOCUMENTS 5,018,304 A 5/1991 Longoria
5,221,239 A 6/1993 Catlett
(Continued)

OTHER PUBLICATIONS

International Search Report; International Searching Authority; International Patent Application No. PCT/US2020/064881; dated Mar. 19, 2021; 3 pages.
(Continued)

*Primary Examiner* — Justin B Rephann
(74) *Attorney, Agent, or Firm* — Taft Stettinius & Hollister LLP

(57) ABSTRACT

An exemplary method relates to operating a door closer assembly including a closer body, a pinion rotatably mounted to the closer body, a motor including a motor shaft, and a bidirectional clutch connected between the pinion and the motor shaft. The method generally involves permitting, by the clutch, rotation of the pinion in each of a first direction and a second direction without transmitting rotation of the pinion in either direction to the motor shaft; sensing, with a sensor, a rotational position of the pinion; comparing, by a controller, the rotational position of the pinion with a desired rotational position; based upon the comparing, driving the motor to rotate the motor shaft; and by the clutch, coupling the motor shaft with the pinion in response to rotation of the motor shaft, thereby transmitting torque from the motor shaft to the pinion and urging the pinion toward the desired rotational position.

20 Claims, 6 Drawing Sheets

(52) U.S. Cl.
CPC ..... *E05Y 2400/61* (2013.01); *E05Y 2800/70* (2013.01); *E05Y 2900/132* (2013.01)

(58) Field of Classification Search
CPC ..... E05F 3/224; E05F 3/227; E05F 1/105; E05Y 2400/61; E05Y 2800/70; E05Y 2900/132; E05Y 2201/412
See application file for complete search history.

(56) References Cited

U.S. PATENT DOCUMENTS 5,634,296 A * 6/1997 Hebda ..... E05F 15/63 49/28
5,878,530 A 3/1999 Eccleston et al.
5,930,954 A 8/1999 Hebda
6,067,753 A 5/2000 Hebda
6,177,771 B1 1/2001 Kinzer et al.
6,634,140 B1 10/2003 Sellman
6,667,591 B2 12/2003 Mullet et al.
6,751,909 B2 6/2004 Ranaudo
6,891,479 B1 5/2005 Eccleston
6,895,355 B2 5/2005 Fitzgibbon
7,138,912 B2 11/2006 Fitzgibbon et al.
7,208,897 B2 4/2007 Hotto et al.
7,316,096 B2 1/2008 Houser et al.
7,339,336 B2 3/2008 Gregori
7,522,042 B2 4/2009 Milo
7,723,936 B2 5/2010 Schaefer
7,768,256 B2 8/2010 Hechinger
7,795,746 B2 9/2010 Riley et al.
8,169,169 B2 5/2012 Hass et al.
8,225,458 B1 7/2012 Hoffberg
8,248,005 B2 8/2012 Romer
8,359,790 B2 1/2013 Shin
8,390,219 B2 * 3/2013 Houser ..... E05F 15/40 318/400.38
8,405,337 B2 3/2013 Gebhart et al.
8,407,937 B2 4/2013 Houser
8,499,495 B2 8/2013 Houser et al.
8,773,237 B2 * 7/2014 Burris ..... G05B 19/0426 324/130
9,869,117 B2 * 1/2018 Houser ..... E05F 15/60
9,978,194 B2 5/2018 Newby et al.
10,316,568 B2 6/2019 Langenberg et al.
2006/0010771 A1 1/2006 Houser et al.
2009/0265992 A1 10/2009 Hass et al.
2011/0094160 A1 4/2011 Houser
2011/0252598 A1 10/2011 Burris et al.
2012/0029701 A1 * 2/2012 Houser ..... E05F 15/63 49/358
2012/0297581 A1 11/2012 Pitman et al.
2013/0118079 A1 5/2013 Yulkowski et al.
2014/0125067 A1 5/2014 Platzer et al.
2014/0325911 A1 11/2014 Hass
2014/0346997 A1 11/2014 Salutzki et al.
2014/0373454 A1 12/2014 Sasaki
2015/0059249 A1 3/2015 Yulkowski
2015/0061561 A1 3/2015 Roppongi et al.
2015/0113876 A1 4/2015 Burris et al.
2015/0137963 A1 5/2015 Yulkowski et al.
2015/0275563 A1 10/2015 Fujimoto et al.
2015/0280618 A1 10/2015 Ressel et al.
2015/0280635 A1 10/2015 Fujimoto et al.
2015/0316915 A1 11/2015 Balder
2016/0024831 A1 1/2016 Houser et al.
2016/0033024 A1 2/2016 Yulkowski
2016/0108656 A1 4/2016 Sugiura
2016/0123064 A1 5/2016 Wagner et al.
2017/0159344 A1 6/2017 Langenberg et al.

OTHER PUBLICATIONS

Written Opinion of the International Searching Authority; International Searching Authority; International Patent Application No. PCT/US2020/064881; dated Mar. 19, 2021; 7 pages.
Canadian Examination Report; Canadian Intellectual Property Office; Canadian Application No. 3,161,724; dated Sep. 7, 2023; 4 pages.

* cited by examiner

POWER BOOST MODULE

CROSS REFERENCE TO RELATED APPLICATIONS

This application is a continuation of U.S. patent application Ser. No. 16/713,196 filed Dec. 13, 2019 and issued as U.S. Pat. No. 11,142,939, the contents of which are hereby incorporated by reference in their entirety.

TECHNICAL FIELD

The present disclosure generally relates to door closers, and more particularly but not exclusively relates to retrofit modules for existing door closers.

BACKGROUND

Certain provisions of the Americans with Disabilities Act require that doors be capable of being opened with a maximum force of five pounds. Using standard mechanical door closers, this requirement is occasionally met by reducing the preload on a set of springs that compress when the door is opening, and which expand when the door is closing. The compression of these springs is the source of the force the door closer has available to secure the door. As the door closer is adjusted to meet the maximum opening force requirement, the amount of force available to close the door also decreases.

With a weak closer, doors can get stuck open by varying pressures within a building caused by HVAC, gusts of wind, or debris preventing the door from swinging freely. This can cause issues for building security personnel, for example those who may have to check when doors are sensed as being propped open. Open doors can also reduce the efficiency of HVAC systems as the building may lose heat or cool air to the outside of the building.

One solution in the market for these applications is to install an auto operator. An auto operator frequently requires extensive work to get power and controls to the door opening, and may not be feasible in all retrofit situations due to aging buildings or renovation budgets. Another solution is to install an electronic door closer that can apply additional force on the closing cycle by use of an electric motor. Current market solutions sell a new closer assembly and create waste by having the customer discard the previous mechanical door closer. For these reasons among others, there remains a need for further improvements in this technological field.

SUMMARY

An exemplary method relates to operating a door closer assembly comprising a closer body, a pinion rotatably mounted to the closer body, a motor including a motor shaft, and a bidirectional clutch connected between the pinion and the motor shaft. The method generally involves permitting, by the bidirectional clutch, rotation of the pinion in each of a first direction and a second direction without transmitting rotation of the pinion in either direction to the motor shaft; sensing, with a sensor, a rotational position of the pinion; comparing, by a controller, the rotational position of the pinion with a desired rotational position; based upon the comparing, driving the motor to rotate the motor shaft; and by the bidirectional clutch, coupling the motor shaft with the pinion in response to rotation of the motor shaft, thereby transmitting torque from the motor shaft to the pinion and urging the pinion toward the desired rotational position. Further embodiments, forms, features, and aspects of the present application shall become apparent from the description and figures provided herewith.

DETAILED DESCRIPTION OF ILLUSTRATIVE EMBODIMENTS

Figure 1:
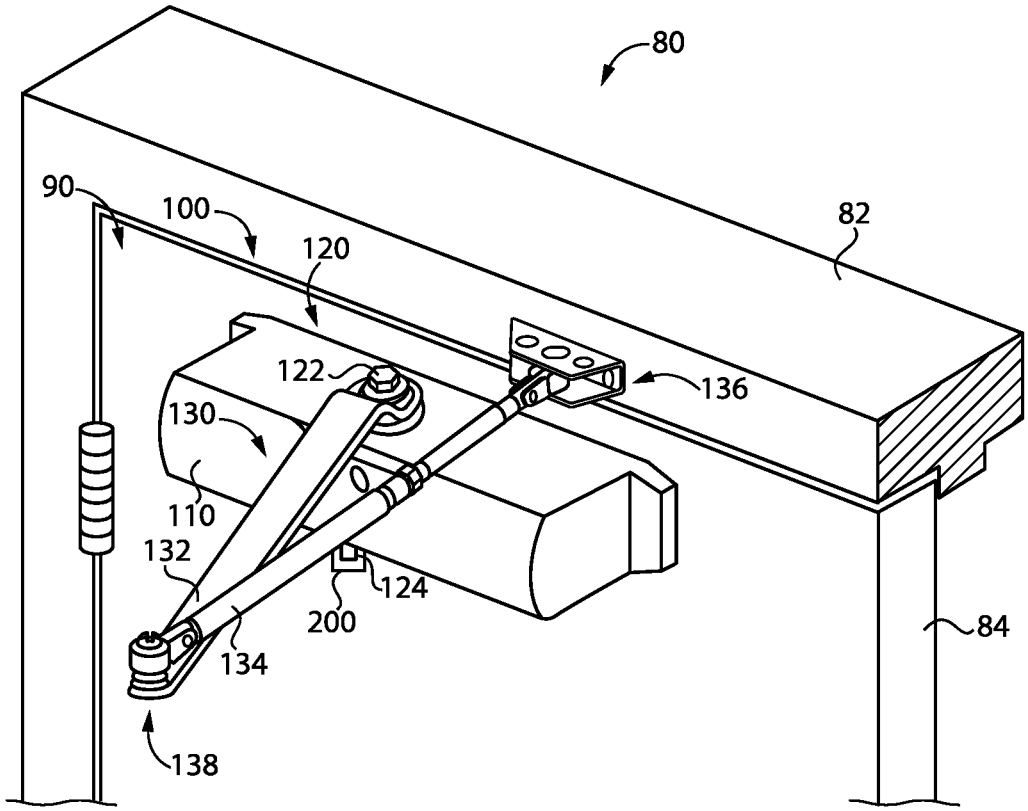
FIG. 1 is a perspective view of a closure assembly according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

With reference to FIG. 1, illustrated therein is a closure assembly 80 including a doorframe 82, a door 84 pivotably mounted to the doorframe 82, and a door closer assembly 90 according to certain embodiments. The closer assembly 90 generally includes a door closer 100 and a power boost module 200 according to certain embodiments. The door closer 100 includes a body 110, a pinion 120 rotatably mounted to the body 110, and an armature 130 connected with the pinion 120. As described herein, the power boost module 200 is connected with the pinion 120 and is configured to provide a boost force to aid in closing of the door 84.

The pinion 120 includes a first end portion 122 connected with the armature 130 and an opposite second end portion 124 connected with the power boost module 200. In the illustrated form, the armature 130 includes a first arm 132 rotationally coupled with the pinion 120, a second arm 134 pivotably coupled to the doorframe 82 via a shoe 136, and a pivot joint 138 by which the first arm 132 is pivotably coupled with the second arm 134. In other embodiments, the armature 130 may include a single rigid arm having first and second ends, wherein the first end is rotationally coupled with the pinion 120 and the second end is slidably mounted in a track that is mounted to the member of the closure assembly 80 (i.e., the doorframe 82 or the door 84) to which the body 110 is not mounted. The illustrated armature 130 is provided in a "standard" configuration, in which the arms 132, 134 extend away from the door 84 when the door 84 is in its closed position. It is also contemplated that the armature 130 may be provided in a "parallel arm" configuration, in which the arms 132, 134 extend generally parallel to the face of the door 84 when the door 84 is in its closed position. Furthermore, while the illustrated closer body 110 is mounted to the surface of the door 84, it is also contemplated that the closer body 110 may be mounted within the door 84 or within the doorframe 82.

In the illustrated embodiment, the closer body 110 is mounted to the door 84, and the shoe 136 is mounted to the doorframe 82 such that the armature assembly 130 is connected between the pinion 120 and the doorframe 82. In other embodiments, the closer body 110 is mounted to the doorframe 82, and the shoe 136 is mounted to the door 84 such that the armature assembly 130 is connected between the pinion 120 and the doorframe 82. Thus, in certain embodiments, the door closer assembly 90 is configured for mounting to a closure assembly 80 including a first structure and a second structure, and includes a body 110 configured for mounting to the first structure, a pinion 120 rotatably mounted to the body 110, and an armature 130 connected between the pinion 120 and the second structure, wherein one of the first structure or the second structure comprises a doorframe 82, and the other of the first structure or the second structure comprises a door 84 swingingly mounted to the doorframe 82.

The door 84 is movable relative to the doorframe 82 between an open position and a closed position, and the closer assembly 90 facilitates the movement of the door 84 toward the closed position by exerting forces on the pinion 120. More particularly, the door closer assembly 90 is configured to urge the door 84 from the open position toward the closed position by urging the pinion 120 in a door-closing direction. Those skilled in the art will readily appreciate that rotation of the pinion 120 in the door-closing direction is correlated with closing of the door 84 by the armature 130. The door closer 100 may, for example, include a hydraulic system, a mechanical system, and/or an electromechanical system that provides the closer 100 with the ability to exert the appropriate forces on the pinion 120. The door closer 100 may be provided as any of several conventional types of door closer that controls movement of a door by exerting forces on a rotatable pinion. Door closers of this type are known in the art, and need not be described in further detail herein.

Figure 2:
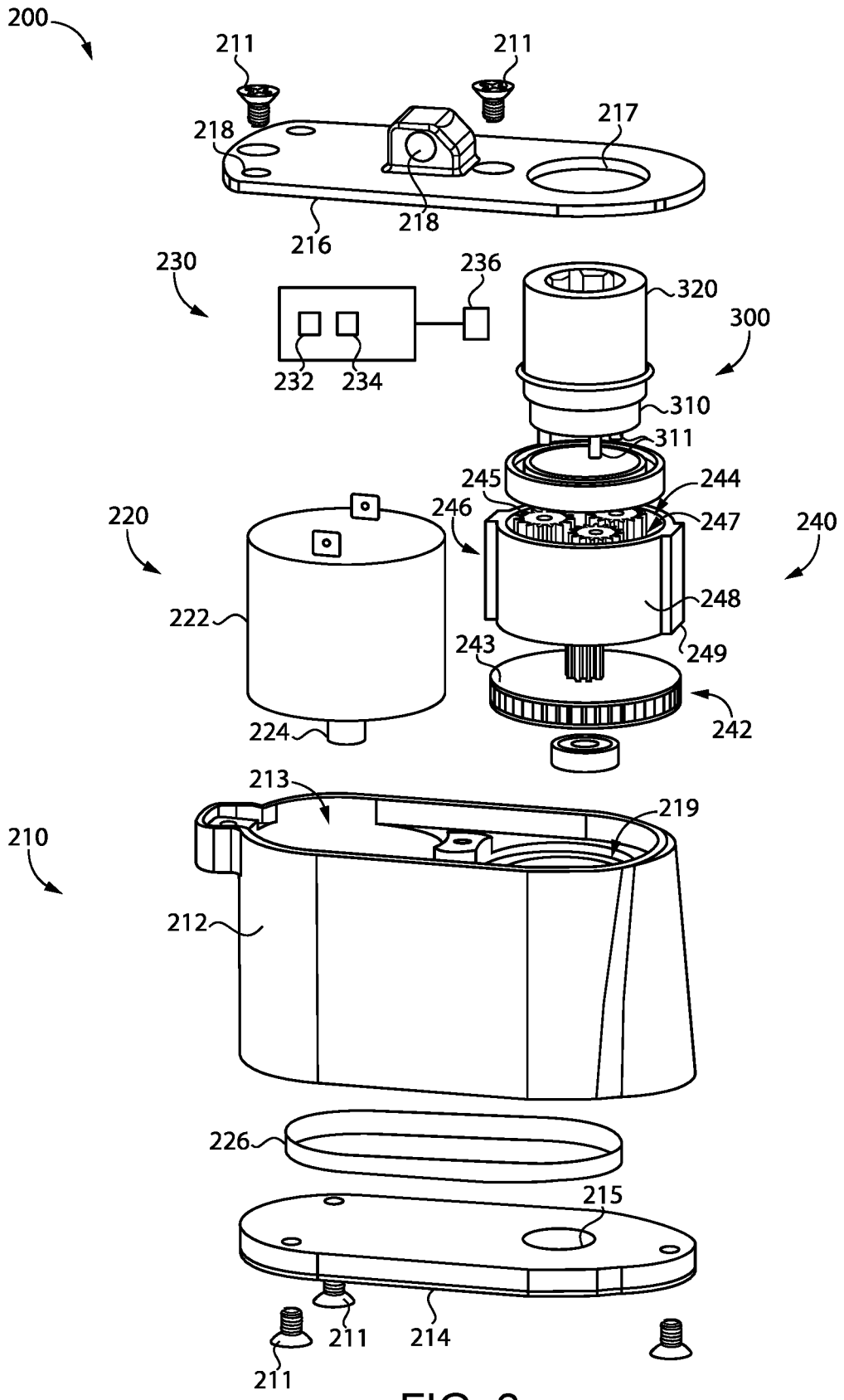
FIG. 2 is an exploded assembly view of a power boost module according to certain embodiments.

With additional reference to FIG. 2, the power boost module 200 generally includes a housing 210, a motor 220 mounted in the housing 210, a control assembly 230 in communication with the motor 220 such that the control assembly 230 is operable to control operation of the motor 220, a reduction gear set 240 operably connected with the motor 220 such that the motor 220 is operable to drive the reduction gear set 240, and a bidirectional clutch 300 connected between the reduction gear set 240 and the pinion 120. As described herein, the clutch 300 includes a clutch input component 310 connected with the motor 220 via the reduction gear set 240 and a clutch output component 320 engaged with the pinion 120, and is configured to transmit rotation from the input component 310 to the output component 320 without transmitting rotation from the output component 320 to the input component 310.

The housing 210 generally includes a housing body 212 having a chamber 213 defined therein, a first cover 214 at least partially enclosing a first end of the chamber 213, and a second cover 216 that partially encloses an opposite second side of the chamber 213. The first cover 214 may include an opening 215 through which a portion of the reduction gear set 240 is accessible, and the second cover 216 includes an opening 217 through which the pinion 120 extends for connection with the clutch 300. The covers 214, 216 may, for example, be coupled to the body 212 with fasteners such as screws 211. The housing 210 may further include one or more mounting apertures 218 by which the housing 210 can be secured to the closer body 110 and/or the door 84 by fasteners such as bolts.

The motor 220 includes a motor body 222 and an output shaft or motor shaft 224 rotatably mounted to the body 222. The motor shaft 224 is operably coupled with the reduction gear set 240 such that rotation of the shaft 224 drives the reduction gear set 240. In the illustrated form, the motor shaft 224 is operably connected with the reduction gear set 240 via a belt 226. In other embodiments, the motor shaft 224 may be directly engaged with the reduction gear set 240, or may interface with the reduction gear set 240 through a transmission other than a belt, such as one or more gears. The motor 220 is configured to rotate the motor shaft 224 in response to receiving a drive signal from the control assembly 230. As described herein, such rotation of the motor shaft 224 drives rotation of the clutch 300 via the reduction gear set 240, thereby rotating the pinion 120.

Figure 3:
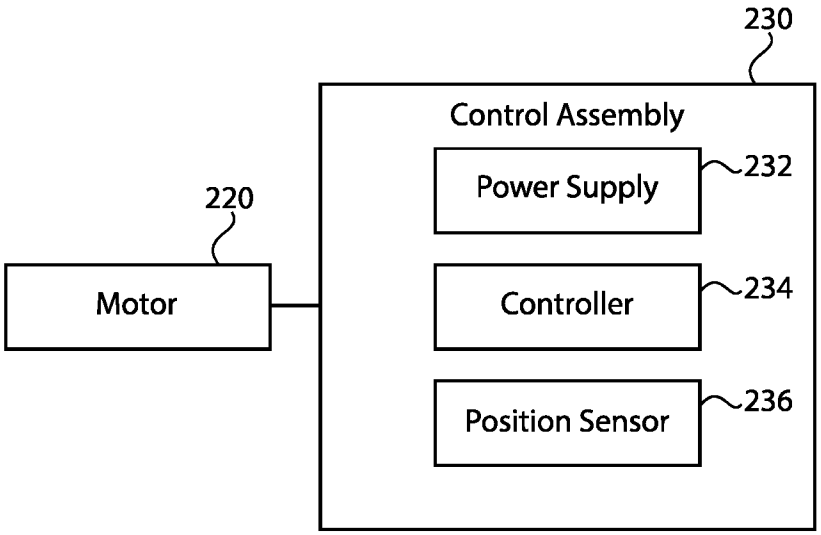
FIG. 3 is a schematic block diagram of a control assembly according to certain embodiments.

With additional reference to FIG. 3, the control assembly 230 generally includes an onboard power supply 232, a controller 234 operable to power the motor 220 using electrical power drawn from the power supply 232, and a position sensor 236 operable to sense the rotational position of the pinion 120. The power supply 232 may, for example, take the form of one or more batteries and/or one or more supercapacitors. In certain embodiments, the control assembly 230 may instead be configured for connection to line power, in which case the onboard power supply 232 may be omitted. The controller 234 is in communication with the motor 220 and the sensor 236, and as described herein, is configured to control operation of the motor 220 based at least in part upon information received from the sensor 236. As noted above, the sensor 236 is configured to sense the rotational position of the pinion 120. In certain embodiments, the sensor 236 may sense the rotational position of the pinion 120 by sensing the rotational position of a component of the clutch 300. For example, the sensor 236 may sense the rotational position of the pinion 120 by sensing the rotational position of the clutch output component 320, which is rotationally coupled with the pinion 120. The sensor 236 may take any of a number of forms, and may, for example, be provided as a magnetic sensor, an optical sensor, a rotary encoder, or another form of sensor operable to sense the rotational position of the pinion 120.

Figure 4:
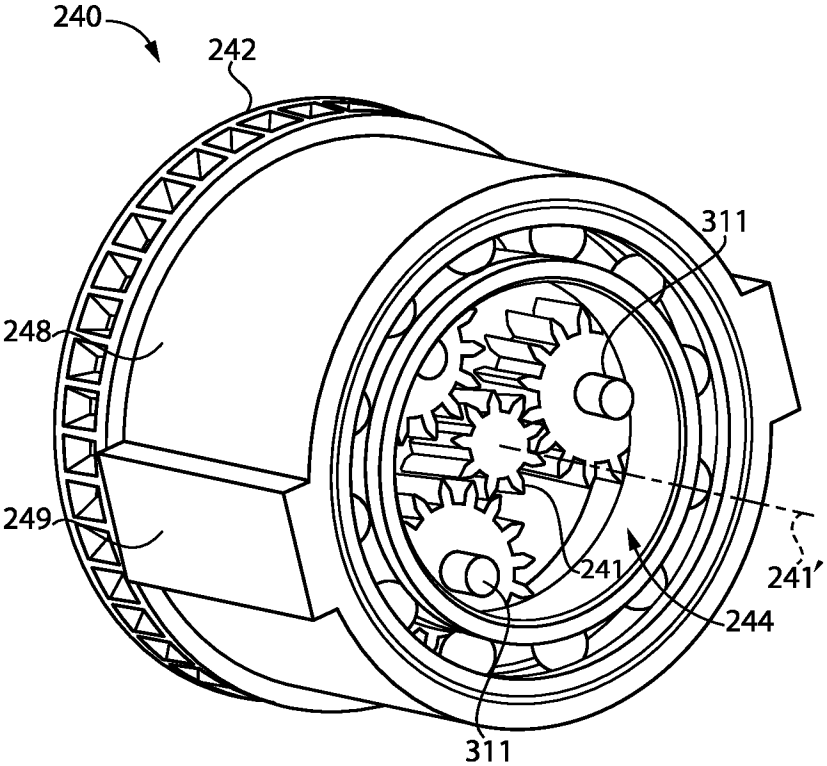
FIG. 4 is a perspective view of a reduction gear set according to certain embodiments.

With additional reference to FIG. 4, the reduction gear set 240 includes a reduction gear set input component 242 operably coupled with the motor shaft 224 (for example, via the belt 226), and a reduction gear set output component 244 driven by rotation of the reduction gear set input component 242. The input component 242 includes an input gear 243, the output component 244 includes at least one output gear 245, and the reduction gear set 240 may further include one or more additional gears 246 that facilitate rotation of the output component 244 in response to rotation of the input component 242. In the illustrated form, the reduction gear set 240 is provided as a planetary gearbox in which the sun gear 241 is coupled with the input gear 243, and the at least one additional gear 246 includes a ring gear 247.

The ring gear 247 is held stationary by the housing 210 such that the output planet gears 245 rotate about a revolutionary axis 241' defined by the sun gear 241 in response to rotation of the input gear 243. More particularly, each planet gear 245 rotates about an axis defined by a corresponding axle 311 while revolving about the revolutionary axis 241' defined by the sun gear 241. While other forms are contemplated, in the illustrated embodiment, the ring gear 247 is defined within a housing 248 having at least one spline 249 formed on the exterior thereof, and the spline(s) 249 mesh with one or more channels 219 formed within the chamber 213 such that the housing 248 is rotationally coupled with the housing 210. While the illustrated reduction gear set 240 is provided in the form of a planetary gearbox, it is to be appreciated that other types of reduction gear sets are also contemplated for use as a reduction gear set that connects the motor shaft 224 with the clutch input component 310. In further forms, the reduction gear set 240 may be omitted, and the motor shaft 224 may be directly engaged with the clutch input component 310, or engaged with the clutch input component 310 via non-geared components, such as a belt 226.

Figure 6:
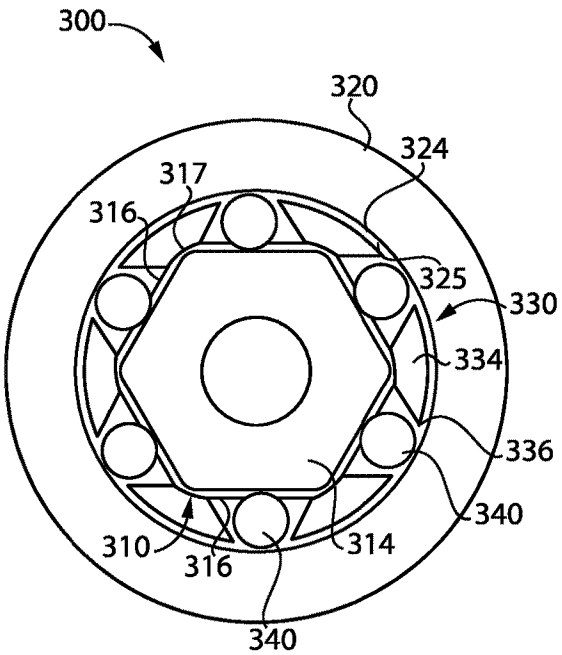
FIG. 6 is a cross-sectional illustration of the clutch illustrated in FIG. 5.
Figure 5:
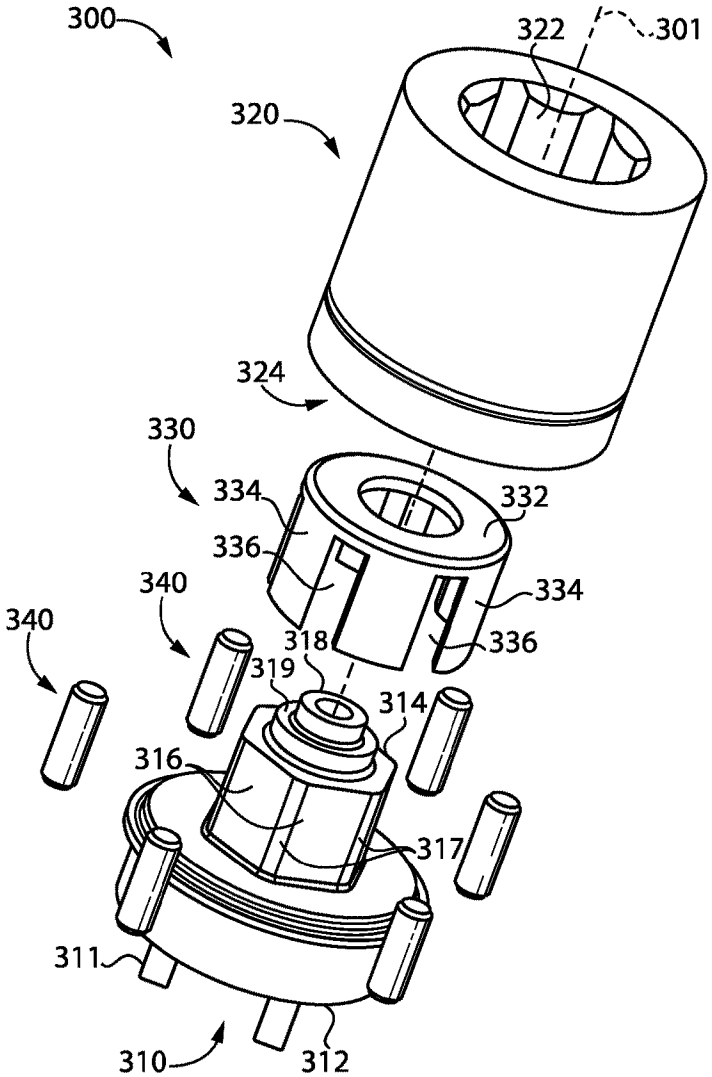
FIG. 5 is an exploded assembly view of a clutch according to certain embodiments.

With additional reference to FIGS. 5 and 6, the bidirectional clutch 300 generally includes a clutch input component 310, a clutch output component 320, a bearing cage 330 mounted between the input component 310 and the output component 320, and a plurality of roller bearings or rollers 340 captured between a radially-outer surface 315 of the input component 310 and a radially-inner surface 325 of the output component 320. As described herein, the clutch 300 is configured to permit bidirectional rotation of the output component 320 relative to the input component 310, and to rotationally couple the components 310, 320 in response to rotation of the input component 310 in either direction about a rotational axis 301. While other forms are contemplated, in the illustrated form, the rotational axis 301 is generally coincident with the revolutionary axis 241'.

The clutch input component 310 includes a base portion 312 and a post 314 having a generally polygonal cross-section extending from the base portion 312. The post 314 has a radially-outer surface 315 that includes a plurality of sides or faces 316, which meet at vertices 317. While the illustrated post 314 is substantially hexagonal in cross-section, it is also contemplated that other geometries may be utilized. The post 314 may include a stepped boss including an upper tier 318 that rotatably supports the clutch output component 320 and a lower tier 319 that rotatably supports the bearing cage 330. Extending from the base portion 312 in a direction opposite that of the post 314 is at least one axle 311. Each axle 311 is engaged with a corresponding output gear 245 such that the input component 310 rotates about the rotational axis 301 as the planet gears 245 revolve about the revolutionary axis 241'. As a result, rotation of the motor shaft 224 causes a corresponding rotation of the clutch input component 310.

The clutch output component 320 includes a recess 322 that is sized and shaped for rotational coupling with the pinion 120, and a chamber 324 having a generally circular radially-inner surface 325. The chamber 324 receives the post 314, the cage 330, and the bearings 340 such that the cage 330 and the bearings 340 are captured between the outer surface 315 of the post 314 and the inner surface 325 of the chamber 324. The chamber 324 may have defined therein a circular recess sized and shaped to receive the upper tier 318 of the stepped boss such that the input component 310 rotatably supports the output component 320.

The bearing cage 330 includes an annular base plate 332 and a plurality of flanges 334 extending from the base plate 332 such that slots 336 are defined between the flanges 334. The annular plate 332 receives the upper tier 318 of the stepped boss and is seated on the lower tier 319 of the stepped boss such that the clutch input component 310 rotatably supports the bearing cage 330.

Each of the roller bearings 340 is seated in a corresponding one of the slots 336 such that each bearing 340 is radially captured between the outer surface 315 of the post 314 and the inner surface 325 of the chamber 324, and is tangentially captured between a pair of the flanges 334. While the illustrated roller bearings 340 are cylindrical, it is also contemplated that one or more of the bearings 340 may instead be spherical. Additionally, while the illustrated clutch 300 includes six bearings 340 corresponding to the six faces 316, it is also contemplated that the number of bearings 340 may not necessarily correspond to the number of faces 316. For example, the clutch 340 may include only three bearings 340, which may be positioned such that the faces 316 alternate between bearing-engaging faces and non-bearing-engaging faces.

As noted above, the clutch 300 is configured such that rotation of the clutch output component 320 does not cause a corresponding rotation of the clutch input component 310, and such that rotation of the clutch input component 310 causes rotation of the clutch output component 320. In other words, the clutch output component 320 is rotatable relative to the clutch input component 310, but the clutch input component 310 is not rotatable relative to the clutch output component 320. This feature is illustrated in FIGS. 7-9.

Figure 7:
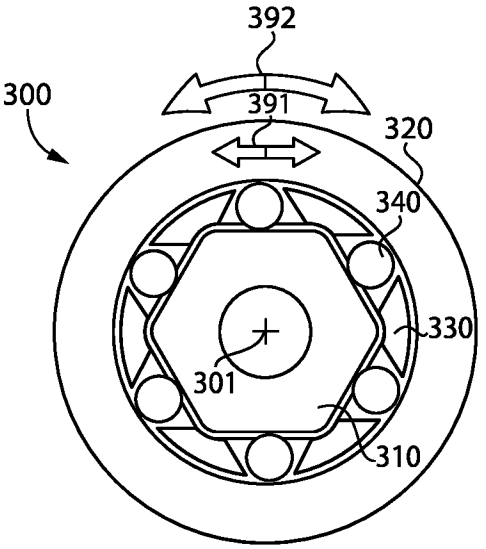
FIG. 7 is a cross-sectional view of the clutch permitting rotation of a clutch output component relative to a clutch input component.

With additional reference to FIG. 7, illustrated therein is the clutch 300 during rotation of the clutch output component 320 relative to the clutch input component 310. As the output component 320 rotates, the frictional forces imparted by the inner surface 325 of the chamber 324 to the rollers 340 are generally in the tangential direction, as indicated by the arrow 391. As a result, the rollers 340 roll along the surfaces 315, 325 without catching against the outer surface 315 of the post 314. Thus, the output component 320 is free to rotate relative to the input component 310 in both the clockwise direction and the counter-clockwise direction, as indicated by the double-headed arrow 392.

Figure 8:
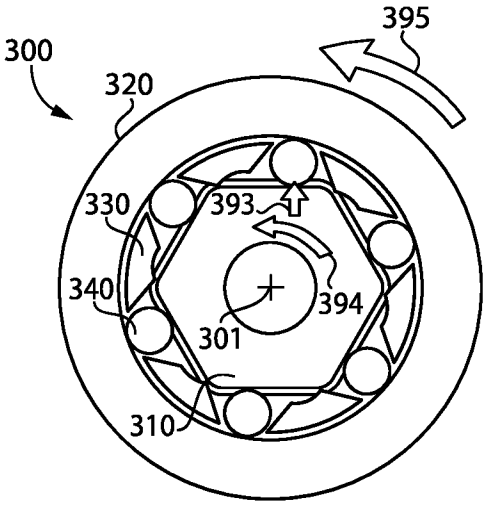
FIG. 8 is a cross-sectional view of the clutch rotationally coupling the clutch output component with the clutch input component in response to rotation of the clutch input component in a counter-clockwise direction.
Figure 9:
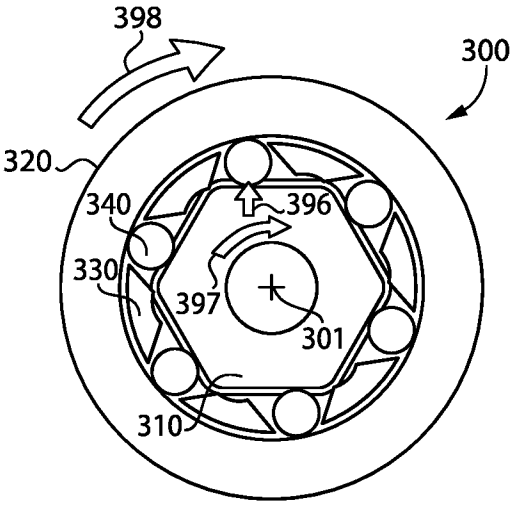
FIG. 9 is a cross-sectional view of the clutch rotationally coupling the clutch output component with the clutch input component in response to rotation of the clutch input component in a clockwise direction.

With additional reference to FIG. 8, illustrated therein is the clutch 300 during attempted rotation of the clutch input component 310 relative to the clutch output component 320 in the counter-clockwise direction. As the input component 310 begins to rotate, the faces 316 of the post 314 urge the rollers 340 in the radially-outward direction, as indicated by the arrow 393. As a result, the rollers 340 cause the clutch 300 to bind up, thereby rotationally coupling the components 310, 320. Thus, rotation 394 of the input component 310 in the counter-clockwise direction causes a corresponding rotation 395 of the output component 320 in the counter-clockwise direction.

With additional reference to FIG. 8, illustrated therein is the clutch 300 during attempted rotation of the clutch input component 310 relative to the clutch output component 320 in the clockwise direction. As the input component 310 begins to rotate, the faces 316 of the post 314 urge the rollers 340 in the radially-outward direction, as indicated by the arrow 396. As a result, the rollers 340 cause the clutch 300 to bind up, thereby rotationally coupling the components 310, 320. Thus, rotation 397 of the input component 310 in the clockwise direction causes a corresponding rotation 398 of the output component 320 in the clockwise direction.

As should be evident from the foregoing, the bidirectional clutch 300 permits bidirectional rotation of the output component 320 relative to the input component 310. As a result, when the output component 320 is rotationally coupled with the pinion 120, the pinion 120 is free to rotate without causing a corresponding rotation of the input component 310. Thus, the door 84 is able to move between its open position and its closed position without causing rotation of the motor shaft 224. As should also be evident from the foregoing, the bidirectional clutch 300 rotationally couples the components 310, 320 in response to rotation of the input component 310 in either direction. As a result, when the output component 320 is rotationally coupled with the pinion 120, rotation of the motor shaft 224 is transmitted to the pinion 120 such that the motor 220 is operable to exert at least one of an opening force or a closing force to aid the door 84 in moving to a desired position.

In the illustrated form, the power boost module 200 is provided as a modular add-on component configured for use with an existing door closer 100. It is also contemplated that the functional components of the power boost module 200 may be integrated into a door closer at the time of manufacture. In such forms, one or more functional components of the power boost module 200 may, for example, be provided within the closer body 110.

Figure 10:
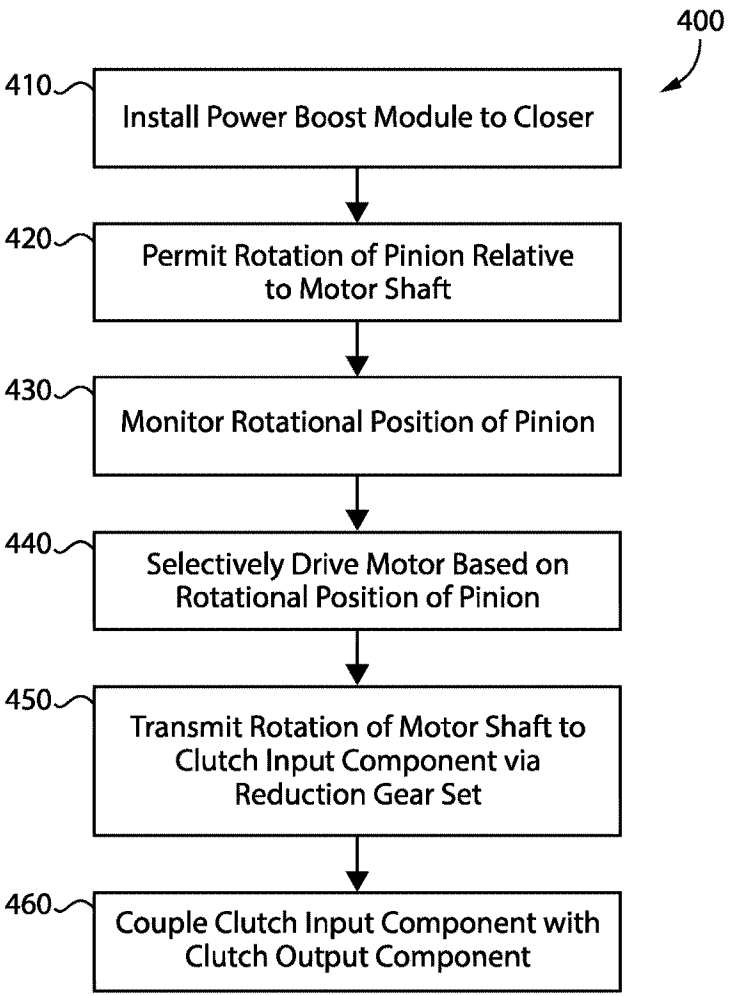
FIG. 10 is a schematic flow diagram of a process according to certain embodiments.

With additional reference to FIG. 10, illustrated therein is a process 400 that may be performed utilizing the power boost module 200. Blocks illustrated for the processes in the present application are understood to be examples only, and blocks may be combined or divided, and added or removed, as well as re-ordered in whole or in part, unless explicitly stated to the contrary. Unless specified to the contrary, it is contemplated that certain blocks performed in the process 400 may be performed wholly by the control assembly 230, or that the blocks may be distributed among one or more of the elements and/or additional devices or systems that are not specifically illustrated in FIGS. 1-9. Additionally, while the blocks are illustrated in a relatively serial fashion, it is to be understood that two or more of the blocks may be performed concurrently or in parallel with one another. Furthermore, while the process 400 is described with specific reference to the illustrated power boost module 200, it is to be appreciated that the process 400 may be performed using power boost modules having additional or alternative features not specifically described with reference to the illustrated power boost module 200.

The process 400 may begin with block 410, which generally involves installing the power boost module 200 to a closure assembly 80 including an existing door closer 100. As noted above, the door closer 100 generally includes a closer body 110 mounted to a first structure of the closure assembly 80 (e.g., one of a doorframe 82 or a door 84), a pinion 120 rotatably mounted to the body 110, and an armature 130 connected between the pinion 120 and a second structure of the closure assembly 80 (e.g., the other of a doorframe 82 or a door). Block 410 generally involves rotationally coupling the pinion 120 to the clutch output component 320, for example by inserting the second end portion 124 of the pinion 120 into the correspondingly-shaped recess 322 in the output component 320. Block 410 may further involve securing the housing 210 to at least one of the closer body 110 or the first structure, such as by passing mounting bolts through the mounting apertures 218 such that the mounting bolts engage the closer body 110 and/or the first structure.

As a result of block 410, the power boost module 200 is installed to the closer 100 such that the closer assembly 90 includes the closer 100 and the power boost module 200. In the illustrated form, the power boost module 200 is provided as a modular retrofit add-on that is configured for use with the closer 100. In other embodiments, the functional components of the power boost module 200 may be provided in a closer assembly 90 at the time of sale. In either event, the closer assembly 90 will, in at least some embodiments, generally include a housing 110, a pinion 120 rotatably mounted to the housing 110, an armature 130 coupled with the pinion 120, a motor 220 engaged with the pinion 120 via a bidirectional clutch 300, a sensor 236 operable to sense the rotational position of the pinion 120, and a controller 234 configured to control operation of the motor 220 based on information received from the sensor 236.

The process 400 further includes block 420, which generally involves permitting the pinion 120 to rotate without causing a corresponding rotation of the motor shaft 224. Block 420 may be performed at least in part by the clutch 300. For example, block 420 may involve permitting the clutch output component 320 to rotate freely relative to the clutch input component 310 such that the motor shaft 224 does not rotate in response to rotation of the pinion 120. As a result, the pinion 120 is free to rotate without backdriving the motor 220 or otherwise causing the motor 220 to operate.

The process 400 further includes block 430, which generally involves monitoring the rotational position of the pinion 120. Block 430 may, for example, be performed at least in part by the position sensor 236. In the illustrated embodiment, block 430 involves sensing the rotational position of the pinion 120 by sensing the rotational position of the clutch output component 320. In other embodiments, block 430 may involve sensing the rotational position of the pinion 120 directly or via a component other than the clutch output component 320.

The process 400 further includes block 440, which generally involves selectively driving the motor 220 based upon the rotational position of the pinion 120. Block 440 may, for example, be performed at least in part by the controller 234. In certain embodiments, block 440 involves comparing the sensed rotational position of the pinion 120 to a desired rotational position for the pinion 120, and driving the motor 220 such that the motor shaft 224 rotates in a direction that will urge the pinion 120 toward its desired position. In certain embodiments, the desired position of the pinion 120 corresponds to a closed position of the door 84. In other embodiments, the desired position of the pinion 120 corresponds to an open position of the door 84.

In certain forms, the controller 234 may drive the motor 220 based upon the current rotational position of the pinion 120. For example, the controller 234 may drive the motor 220 to urge the pinion 120 toward its desired position when the current rotational position is within a threshold angle of the desired position.

In certain embodiments, the controller 234 may drive the motor 220 based in part upon past positions of the pinion 120. For example, the controller 220 may operate the motor 220 to drive the pinion 120 toward its desired position when the past and current positions of the pinion 120 indicate that the pinion 120 is rotating toward the desired position, and may not necessarily drive the motor 220 when the past and current positions indicate that the pinion 120 is traveling away from its desired position (e.g., under the urging of a person opening the door 84).

In certain embodiments, the controller 234 may drive the motor 220 in response to detecting a stall condition. For example, the controller 234 may drive the motor 220 to urge the pinion 120 toward the desired position when the positional information received from the sensor 236 indicates that the pinion 120 has stalled before reaching the desired position. By way of illustration, if the desired position for the pinion 120 corresponds to a closed position for the door 84, differences in pressure between the regions separated by the door 84 may cause the air flowing between the regions to prop the door in a slightly-open position. In such forms, the power boost module 200 may provide to the closer 100 the power boost necessary to drive the door 84 to the desired closed position against the force of the airflow.

The process 400 may further include block 450, which generally involves transmitting the rotation of the motor shaft 220 to the clutch input component 310 via a reduction gear set such as the reduction gear set 240. In the illustrated form, the output of the reduction gear set 240, when compared with the input to the reduction gear set 240, is reduced in rotational speed and increased in torque. More particularly, while the motor 220 provides to the input gear component 242 a first speed and a first torque, the reduction gear set 240 imparts to the clutch input component 310 a second speed that is less than the first speed and a second torque that is greater than the first torque.

The process 400 further includes block 450, which generally involves coupling the clutch input component 310 with the clutch output component 320 in response to rotation of the clutch input component 310. As a result of the coupling, the torque generated by the motor 220 is transmitted to the pinion 120, thereby urging the pinion 120 toward its desired position. As a result, the power boost module 200 provides to the closer 100 a power boost that urges the door 84 toward a desired door position corresponding to the desired position of the pinion 120.

As noted above, in certain embodiments, the desired position of the pinion 120 corresponds to a closed position of the door 84. In such forms, the power boost module 200 may provide to the closer 100 a power boost that aids in the closing motion of the door 84. As also noted above, this closing movement of the door may be hindered by pressure differentials between the regions separated by the door 84, among other factors. In certain embodiments, the configuration of the door closer 100 may be such that the force required to open the door 84 corresponds to the force available for closing the door 84. In such forms, the fact that the bidirectional clutch 300 permits the pinion 120 to rotate without backdriving or otherwise operating the motor 220 while permitting the motor 220 to impart a torque urging the pinion 120 toward its desired position may enable the closer assembly 90 to provide the force necessary to return the door 84 to its closed position while maintaining the force required to open the door 84 below a threshold value, such as five pounds.

In other embodiments, the desired position of the pinion 120 corresponds to an open position of the door 84. In such forms, the power boost module 200 may provide to the closer 100 a power boost that aids in the opening motion of the door 84. This opening movement of the door may be hindered by pressure differentials between the regions separated by the door 84, or in the event that the internal springs of the closer body 110 have been set to provide high biasing forces urging the door 84 toward its closed position. In certain embodiments, the configuration of the door closer 100 may be such that the force required to open the door 84 corresponds to the force available for closing the door 84. In the event that the closing force is provided as a value greater than the maximum opening force prescribed by regulations, the power boost module 200 may provide a supplemental power assist function that aids in reducing the required opening force to the level prescribed by regulations. For example, should the springs of the closer 100 be set to provide a seven-pound closing force, the power boost module 200 may provide a two-pound opening force to reduce the amount of force that the user is required to exert to the five-pound level required by certain regulations.

Figure 11:
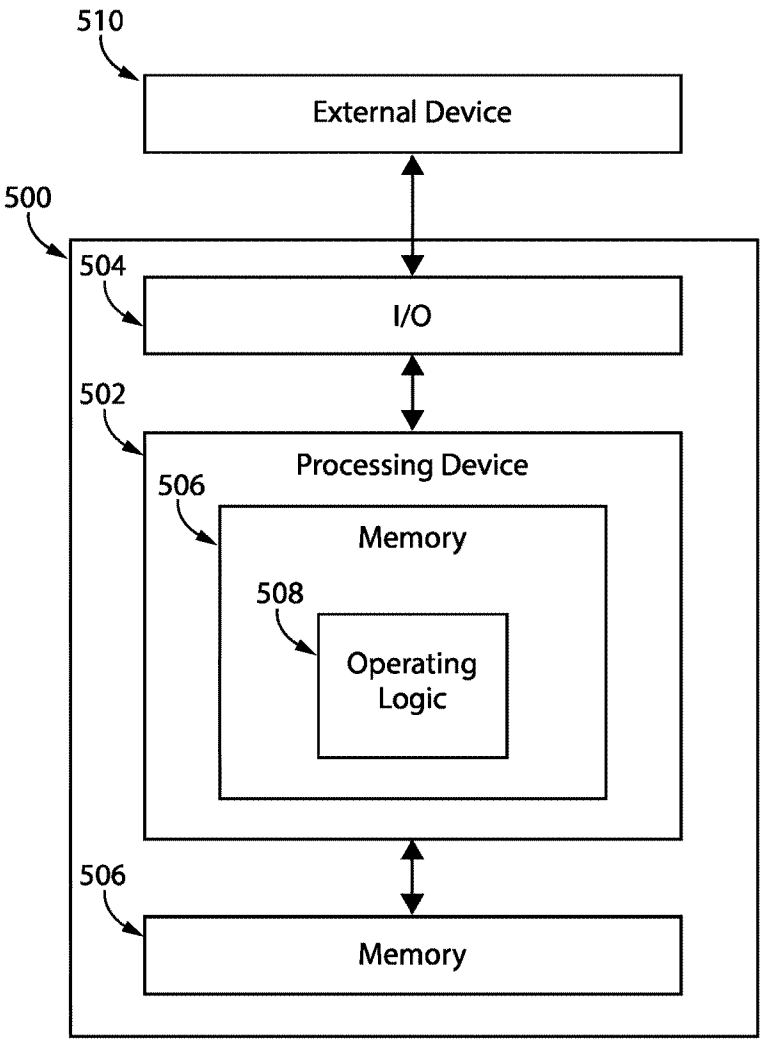
FIG. 11 is a schematic block diagram of a computing device that may be utilized in certain embodiments.

Referring now to FIG. 11, a simplified block diagram of at least one embodiment of a computing device 500 is shown. The illustrative computing device 500 depicts at least one embodiment of a controller that may be utilized in connection with the control assembly 230 illustrated in FIG. 3.

Depending on the particular embodiment, the computing device 500 may be embodied as a server, desktop computer, laptop computer, tablet computer, notebook, netbook, Ultrabook™, mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 500 includes a processing device 502 that executes algorithms and/or processes data in accordance with operating logic 508, an input/output device 504 that enables communication between the computing device 500 and one or more external devices 510, and memory 506 which stores, for example, data received from the external device 510 via the input/output device 504.

The input/output device 504 allows the computing device 500 to communicate with the external device 510. For example, the input/output device 504 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), Wi-Fi®, WiMAX, etc.) to effect such communication depending on the particular computing device 500. The input/output device 504 may include hardware, software, and/or firmware suitable for performing the techniques described herein.

The external device 510 may be any type of device that allows data to be inputted or outputted from the computing device 500. For example, in various embodiments, the external device 510 may be embodied as the motor 220, the sensor 236, or an external device. Further, in some embodiments, the external device 510 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 510 may be integrated into the computing device 500.

The processing device 502 may be embodied as any type of processor(s) capable of performing the functions described herein. In particular, the processing device 502 may be embodied as one or more single or multi-core processors, microcontrollers, or other processor or processing/controlling circuits. For example, in some embodiments, the processing device 502 may include or be embodied as an arithmetic logic unit (ALU), central processing unit (CPU), digital signal processor (DSP), and/or another suitable processor(s). The processing device 502 may be a programmable type, a dedicated hardwired state machine, or a combination thereof. Processing devices 502 with multiple processing units may utilize distributed, pipelined, and/or parallel processing in various embodiments. Further, the processing device 502 may be dedicated to performance of just the operations described herein, or may be utilized in one or more additional applications. In the illustrative embodiment, the processing device 502 is of a programmable variety that executes algorithms and/or processes data in accordance with operating logic 508 as defined by programming instructions (such as software or firmware) stored in memory 506. Additionally or alternatively, the operating logic 508 for processing device 502 may be at least partially defined by hardwired logic or other hardware. Further, the processing device 502 may include one or more components of any type suitable to process the signals received from input/output device 504 or from other components or devices and to provide desired output signals. Such components may include digital circuitry, analog circuitry, or a combination thereof.

The memory 506 may be of one or more types of non-transitory computer-readable media, such as a solid-state memory, electromagnetic memory, optical memory, or a combination thereof. Furthermore, the memory 506 may be volatile and/or nonvolatile and, in some embodiments, some or all of the memory 506 may be of a portable variety, such as a disk, tape, memory stick, cartridge, and/or other suitable portable memory. In operation, the memory 506 may store various data and software used during operation of the computing device 500 such as operating systems, applications, programs, libraries, and drivers. It should be appreciated that the memory 506 may store data that is manipulated by the operating logic 508 of processing device 502, such as, for example, data representative of signals received from and/or sent to the input/output device 504 in addition to or in lieu of storing programming instructions defining operating logic 508. As illustrated, the memory 506 may be included with the processing device 502 and/or coupled to the processing device 502 depending on the particular embodiment. For example, in some embodiments, the processing device 502, the memory 506, and/or other components of the computing device 500 may form a portion of a system-on-a-chip (SoC) and be incorporated on a single integrated circuit chip.

In some embodiments, various components of the computing device 500 (e.g., the processing device 502 and the memory 506) may be communicatively coupled via an input/output subsystem, which may be embodied as circuitry and/or components to facilitate input/output operations with the processing device 502, the memory 506, and other components of the computing device 500. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 500 may include other or additional components, such as those commonly found in a typical computing device (e.g., various input/output devices and/or other components), in other embodiments. It should be further appreciated that one or more of the components of the computing device 500 described herein may be distributed across multiple computing devices. In other words, the techniques described herein may be employed by a computing system that includes one or more computing devices. Additionally, although only a single processing device 502, I/O device 504, and memory 506 are illustratively shown in FIG. 11, it should be appreciated that a particular computing device 500 may include multiple processing devices 502, I/O devices 504, and/or memories 506 in other embodiments. Further, in some embodiments, more than one external device 510 may be in communication with the computing device 500.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A power boost module configured for use with a door closer having a pinion, the power boost module comprising:

a motor including a motor shaft;

a clutch comprising a clutch input component and a clutch output component, the clutch input component rotationally coupled with the motor shaft, the clutch output component configured to be rotationally coupled with the pinion; and a controller configured to selectively actuate the motor;

wherein the clutch is configured to rotationally couple the clutch input component and the clutch output component in response to rotation of the clutch input component; and wherein the clutch is configured to rotationally decouple the clutch input component and the clutch output component in response to rotation of the clutch output component.

2. The power boost module of claim 1, further comprising a housing with said clutch, said motor, and said controller positioned within said housing; and wherein the housing is configured to be removably mounted to at least one of a closer body of the door closer or a structure to which the closer body is mounted.

3. The power boost module of claim 1, wherein the controller selectively actuates the motor to rotationally drive the pinion and provide a door closing force via the door closer.

4. The power boost module of claim 1, further comprising a reduction gear set coupled between the motor shaft and the clutch input component.

5. The power boost module of claim 4, wherein the reduction gear set comprises an input gear coupled with the motor shaft and an output gear coupled with the clutch input component;

wherein the reduction gear set is configured to translate a first torque imparted to the input gear by the motor shaft into a second torque imparted to the clutch input component by the output gear; and wherein the second torque is higher than the first torque.

6. The power boost module of claim 4, wherein the reduction gear set comprises a planetary gear set.

7. The power boost module of claim 1, further comprising an onboard power supply operable to supply electrical power to the controller and the motor.

8. A door closer assembly comprising the power boost module of claim 1, and further comprising the door closer;

wherein the power boost module is removably secured to a closer body of the door closer; and wherein the clutch output component is rotationally coupled with the pinion.

9. A door closer assembly comprising the power boost module of claim 1, the door closer assembly further comprising the door closer;

wherein the door closer further comprises a closer body to which the pinion is rotatably mounted;

wherein the power boost module further comprises a housing separate from the closer body;

wherein the motor, the clutch, and the controller are mounted in the housing; and wherein the housing is releasably secured to the closer body.

10. A power boost module configured for use with a door closer having a pinion, the power boost module comprising:

a motor including a motor shaft;

a clutch comprising a clutch input component and a clutch output component, the clutch input component rotationally coupled with the motor shaft, the clutch output component configured to be rotationally coupled with the pinion;

a controller configured to selectively actuate the motor; and a position sensor operable to sense a rotational position of the clutch output component;

wherein the clutch output component rotates in response to a corresponding rotation of the pinion, and wherein the clutch input component and the motor shaft do not rotate in response to rotation of clutch output component;

wherein the clutch input component rotates in response to a corresponding rotation of the motor shaft, and wherein the clutch output component rotates in response to rotation of the clutch input component to thereby rotationally drive the pinion; and wherein the controller is in communication with the position sensor, and wherein the controller selectively actuates the motor based on the sensed rotational position of the clutch output component.

11. A door closer assembly, comprising:

a door closer comprising a closer body and a pinion rotatably mounted to the closer body, wherein the pinion includes an exposed end portion that projects out of the closer body; and a power boost module separable from the door closer, the power boost module comprising:

a motor including a motor shaft;

a clutch comprising a clutch input component and a clutch output component, wherein the clutch input component is rotationally coupled with the motor shaft, and wherein the clutch output component is matingly engaged with the exposed end portion of the pinion; and a controller configured to selectively actuate the motor;

wherein the clutch output component rotates in response to rotation of the pinion, and wherein the clutch input component and the motor shaft do not rotate in response to rotation of the clutch output component; and wherein the clutch input component rotates in response to rotation of the motor shaft, and wherein the clutch output component rotates in response to rotation of the clutch input component to thereby rotationally drive the pinion.

12. The door closer assembly of claim 11, wherein the clutch comprises a bidirectional clutch connected between the pinion and the motor shaft;

wherein the bidirectional clutch permits rotation of the pinion without transmitting rotation of the pinion to the motor shaft;

wherein the motor is selectively driven to rotate the motor shaft; and wherein the bidirectional clutch rotationally couples the motor shaft with the pinion in response to rotation of the motor shaft, and thereby transmits torque from the motor shaft to the pinion to urge the pinion toward a desired rotational position.

13. The door closer assembly of claim 12, further comprising:

a sensor configured to sense a rotational position of the pinion;

a controller configured to compare the sensed rotational position of the pinion with the desired rotational position of the pinion; and wherein the motor is selectively driven to rotate the motor shaft to drive the pinion toward the desired rotational position.

14. The door closer assembly of claim 12, wherein the door closer assembly is mounted to a closure assembly comprising a doorframe and a door swingingly mounted to the doorframe; and wherein the desired rotational position of the pinion corresponds to a closed position of the door.

15. The door closer assembly of claim 12, wherein the door closer assembly comprises the door closer and the power boost module mounted to the door closer;

wherein the power boost module includes a housing, the bidirectional clutch, and the motor;

wherein the door closer comprises the closer body and the pinion; and wherein the power boost module rotationally couples the pinion with the bidirectional clutch.

16. The door closer assembly of claim 12, wherein the motor shaft is rotationally coupled with the pinion in response to rotation of the motor shaft; and wherein the clutch input component is coupled with the clutch output component in response to rotation of the clutch input component.

17. The door closer assembly of claim 12, wherein the motor is driven with electrical power supplied by an onboard power supply of the door closer assembly.

18. The door closer assembly of claim 11, further comprising a position sensor operable to sense a rotational position of the clutch output component; and wherein the controller is in communication with the position sensor, and wherein the controller selectively actuates the motor based on the sensed rotational position of the clutch output component.

19. The door closer assembly of claim 11, wherein the controller selectively actuates the motor to rotationally drive the pinion and provide a door closing force via the door closer assembly.

20. The door closer assembly of claim 11, further comprising an onboard power supply operable to provide electrical power to the motor.

* * * * *